US009493014B2

(12) United States Patent
Aruga et al.

(10) Patent No.: US 9,493,014 B2
(45) Date of Patent: Nov. 15, 2016

(54) IMAGE FORMING APPARATUS HAVING THREE-POSITION SUPPORT

(71) Applicant: CANON KABUSHIKI KAISHA, Tokyo (JP)

(72) Inventors: Daisuke Aruga, Abiko (JP); Yasuaki Otoguro, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/589,762

(22) Filed: Jan. 5, 2015

(65) Prior Publication Data

US 2015/0202886 A1 Jul. 23, 2015

(30) Foreign Application Priority Data

Jan. 17, 2014 (JP) ..... 2014-006828
Dec. 26, 2014 (JP) ..... 2014-264727

(51) Int. Cl.
*B41J 2/47* (2006.01)

(52) U.S. Cl.
CPC .. *B41J 2/47* (2013.01); *B41J 2/471* (2013.01)

(58) Field of Classification Search
CPC ..... H04N 5/2253; H04N 5/2254; B41J 2/47; B41J 2/471
USPC ..... 347/225, 118, 256; 359/196.1; 358/305
See application file for complete search history.

(56) References Cited

U.S. PATENT DOCUMENTS 5,633,744 A * 5/1997 Nakajima ..... 359/196.1
7,522,326 B1 4/2009 Otoguro ..... 359/216
7,684,099 B2 3/2010 Otoguro ..... 359/216.1
8,947,478 B2 2/2015 Ishidate et al. ..... 347/137
2005/0062836 A1* 3/2005 Nakajima ..... 347/225
2006/0285170 A1* 12/2006 Mamiya ..... 358/305
2014/0375742 A1* 12/2014 Otoguro et al. ..... 347/118
2015/0002594 A1 1/2015 Ishidate et al. ..... 347/118
2015/0029284 A1 1/2015 Otoguro et al. ..... 347/134

FOREIGN PATENT DOCUMENTS

JP 2006-085058 3/2006

OTHER PUBLICATIONS

U.S. Appl. No. 14/602,912, filed Jan. 22, 2015; Applicants: Takehiro Ishidate, Yasuaki Otoguro.

* cited by examiner

*Primary Examiner* — Julian Huffman
*Assistant Examiner* — Sharon A. Polk
(74) *Attorney, Agent, or Firm* — Fitzpatrick, Cella, Harper & Scinto

(57) ABSTRACT

An image forming apparatus including: a light scanning apparatus having an optical box containing a deflector configured to deflect a light beam scanning a photosensitive member, the light scanning apparatus being mounted to a main body of the image forming apparatus by being inserted through an insertion portion formed in the main body; a supporting unit including a first and a second supporting portions to support, in a direction intersecting an inserting direction of the box, the box in a vicinity of a downstream side wall of the optical box in the inserting direction, and a third supporting portion to support the box in a vicinity of an upstream side wall of the box; and a connecting portion configured to connect the box and the main body in the vicinity of the upstream side wall and on at least one side of the third supporting portion in the direction.

6 Claims, 10 Drawing Sheets

IMAGE FORMING APPARATUS HAVING THREE-POSITION SUPPORT

BACKGROUND OF THE INVENTION

1. Field of the Invention

The present invention relates to an image forming apparatus including a light scanning apparatus.

2. Description of the Related Art

An electrophotographic image forming apparatus (hereinafter referred to as "image forming apparatus") is configured to form an image on a sheet through an electrophotographic process. As the image forming apparatus, for example, there are known an electrophotographic copying machine (such as a digital copying machine), an electrophotographic printer (such as a color laser beam printer), and a facsimile machine. The image forming apparatus not only encompasses an image forming apparatus configured to form a monochrome image but also encompasses a color image forming apparatus.

A light scanning apparatus of the image forming apparatus emits a laser beam (hereinafter referred to as "light beam"), and scans a surface of a rotating photosensitive drum with the light beam, to thereby form an electrostatic latent image on the surface of the photosensitive drum. A developing device develops the electrostatic latent image using toner to form a toner image. A transferring device transfers the toner image, which is formed on the photosensitive drum, onto a sheet. A fixing device fixes the toner image onto the sheet by a thermal fixation. In this manner, an image is formed.

In general, a main body of the image forming apparatus includes a frame or side plates opposed to each other. A supporting member configured to support the light scanning apparatus is stretched over the frame or the side plates. The light scanning apparatus is supported by the supporting member in a vertical direction, and is fixed in a state of being supported by the supporting member. The light scanning apparatus (optical box), which is fixed by the supporting member, may be deformed in conformity with the flatness of the supporting member. Therefore, strict design is necessary regarding the flatness of the supporting member and the flatness of a seating surface of the light scanning apparatus, which is held in abutment against the supporting member.

There is known a method of supporting and fixing the light scanning apparatus at three seating surfaces (three points) as a method of stably supporting the light scanning apparatus by the supporting member while preventing the deformation of the light scanning apparatus, which may be caused in conformity with the flatness of the supporting member (Japanese Patent Application Laid-Open No. 2006-85058).

According to Japanese Patent Application Laid-Open No. 2006-85058, the light scanning apparatus is fixed to the supporting member at three seating surfaces. The three seating surfaces are provided at respective apexes of a substantially isosceles triangle, and are arranged in a bottom portion of the light scanning apparatus in a balanced manner in conformity with the shape of the light scanning apparatus. In Japanese Patent Application Laid-Open No. 2006-85058, the seating surfaces are provided at both horizontal end portions on one side of the light scanning apparatus. Further, the seating surface is provided at the center in a width direction on another side of the light scanning apparatus. The seating surfaces are provided on respective fixing portions provided on the light scanning apparatus. Surfaces opposed to the seating surfaces of the fixing portions in the vertical direction are pressed by plate springs, respectively. With this, the light scanning apparatus is fixed to the supporting member.

The image forming apparatus includes driving sources configured to drive the developing device, the photosensitive drum, and the like. Vibrations of various frequencies, which are generated in the driving sources, are transmitted to the light scanning apparatus via the side plates of the image forming apparatus and the supporting member.

When the three seating surfaces are used as in Japanese Patent Application Laid-Open No. 2006-85058, torsional vibration is generated on the other side of the light scanning apparatus due to the vibrations generated in the driving sources. The torsional vibration causes a rotation about a central axis extending from the other side to the one side of the light scanning apparatus and passing through the seating surface at the center on the other side of the light scanning apparatus. However, the one side of the light scanning apparatus is fixed at the seating surfaces of both the horizontal end portions, and hence the torsional vibration that causes a rotation about the central axis is not generated on the one side of the light scanning apparatus. When the torsional vibration is generated on the other side of the light scanning apparatus due to the vibrations generated in the driving sources, a light beam, which is emitted from the light scanning apparatus, scans the photosensitive drum in a vibrating manner. Therefore, the photosensitive drum is irradiated with the light beam with unevenness in irradiation position. The unevenness of the irradiation positions causes an image defect in a stripe shape, which is called "uneven pitch".

The optical box of the light scanning apparatus of such a type that the light beams, which are emitted from a plurality of light sources of the single light scanning apparatus, respectively, are deflected by a single rotary polygon mirror at the same time may have a rectangular parallelepiped shape or a polygonal (quadrangular or more) box shape, which is similar to the rectangular parallelepiped shape, due to the large number of mirrors and lenses and the arrangement thereof. Therefore, when such a light scanning apparatus is fixed to the supporting member at the three seating surfaces, the torsional vibration is generated conspicuously, in particular.

SUMMARY OF THE INVENTION

In view of the above-mentioned problem, the present invention provides an image forming apparatus, which reduces torsional vibration of a light scanning apparatus while avoiding the deformation of the light scanning apparatus due to the flatness of a supporting unit by use of three supporting portions.

In order to achieve the above-mentioned object, according to one embodiment of the present invention, there is provided an image forming apparatus, comprising:

a photosensitive member;

a light scanning apparatus including:

a deflector configured to deflect a light beam so that the light beam scans a surface of the photosensitive member; and an optical box configured to contain the deflector, the optical box being inserted through an insertion portion formed in a side wall of a main body of the image forming apparatus so that the light scanning apparatus is mounted to the main body of the image forming apparatus;

a supporting unit including a first supporting portion, a second supporting portion, and a third supporting portion, the supporting unit being configured to support the optical box, the first supporting portion and the second supporting portion being configured to support, in a direction intersecting an inserting direction of inserting the optical box into the main body of the image forming apparatus, the optical box in a vicinity of a side wall of the optical box on a downstream side in the inserting direction, the third supporting portion being configured to support the optical box in a vicinity of a side wall of the optical box on an upstream side in the inserting direction; and a connecting portion configured to connect the optical box supported by the supporting unit and the main body of the image forming apparatus in the vicinity of the side wall of the optical box on the upstream side in the inserting direction and on at least one side of the third supporting portion in the direction intersecting the inserting direction of the optical box.

Further features of the present invention will become apparent from the following description of exemplary embodiments with reference to the attached drawings.

DESCRIPTION OF THE EMBODIMENTS

The embodiments will be described with reference to the accompanying drawings.

First Embodiment

Image Forming Apparatus

Figure 9:
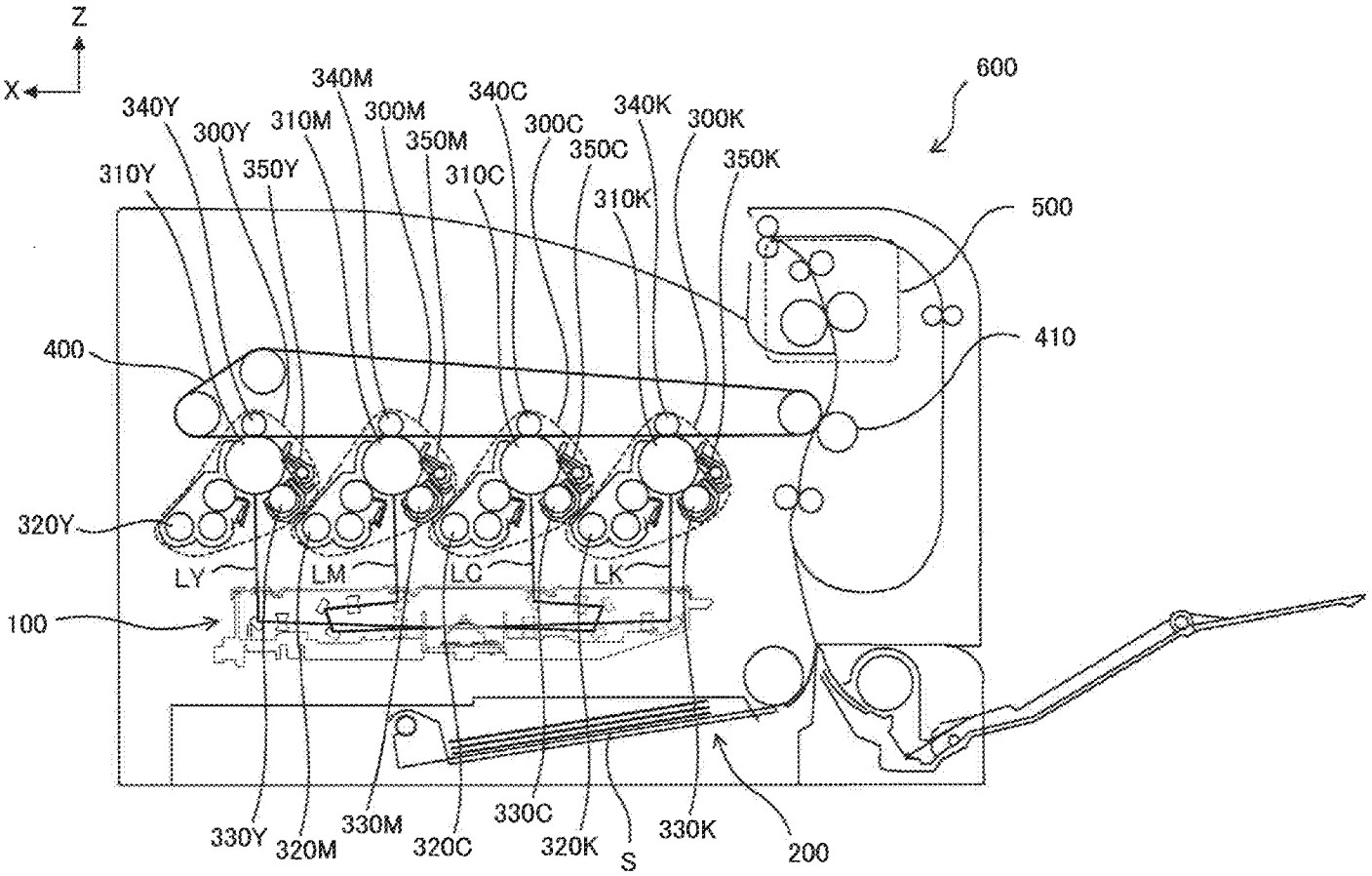
FIG. 9 is a sectional view of an image forming apparatus.

FIG. 9 is a sectional view of an image forming apparatus 600. The image forming apparatus 600 includes four image forming portions 300 (300Y, 300M, 300C, and 300K) configured to form yellow, magenta, cyan, and black toner images, respectively. The image forming portions 300 primarily transfer the respective toner images onto an intermediate transfer belt 400 so as to superimpose the four toner images on the intermediate transfer belt 400. The toner images, which are superimposed on the intermediate transfer belt 400, are secondarily transferred onto a recording medium (hereinafter referred to as a sheet) S to form a color image on the sheet.

The image forming portions 300Y, 300M, 300C, and 300K include photosensitive drums (photosensitive members) 310 (310Y, 310M, 310C, and 310K) as image bearing members, respectively. Around each photosensitive drum 310, there are provided a charging roller 330, a developing device 320, a primary transfer roller 340, and a cleaning device 350. A light scanning apparatus 100 is arranged below the image forming portions 300.

The charging rollers 330 (330Y, 330M, 330C, and 330K) uniformly charge surfaces of the photosensitive drums 310Y, 310M, 310C, and 310K, respectively. The light scanning apparatus 100 scans the uniformly charged surfaces of the photosensitive drums 310Y, 310M, 310C, and 310K with light beams L (LY, LM, LC, and LK) modulated in accordance with image information of the respective colors to form electrostatic latent images on the surfaces of the photosensitive drums 310, respectively.

The developing devices 320 (320Y, 320M, 320C, and 320K) develop the electrostatic latent images with developers (toners) of the respective colors to form the toner images of the respective colors on the photosensitive drums 310.

The primary transfer rollers 340 (340Y, 340M, 340C, and 340K) primarily transfer the toner images on the photosensitive drums 310 onto the intermediate transfer belt 400 to superimpose the four color toner images on the intermediate transfer belt 400.

A secondary transfer roller 410 secondarily transfers the toner images superimposed on the intermediate transfer belt 400 onto the sheet S fed from a feeding portion 200 in a collective manner. The sheet S is conveyed to a fixing device 500. The fixing device 500 fixes the toner images to the sheet S by heat and pressure to form a color image on the sheet S.

[Light Scanning Apparatus]

Figure 4A:
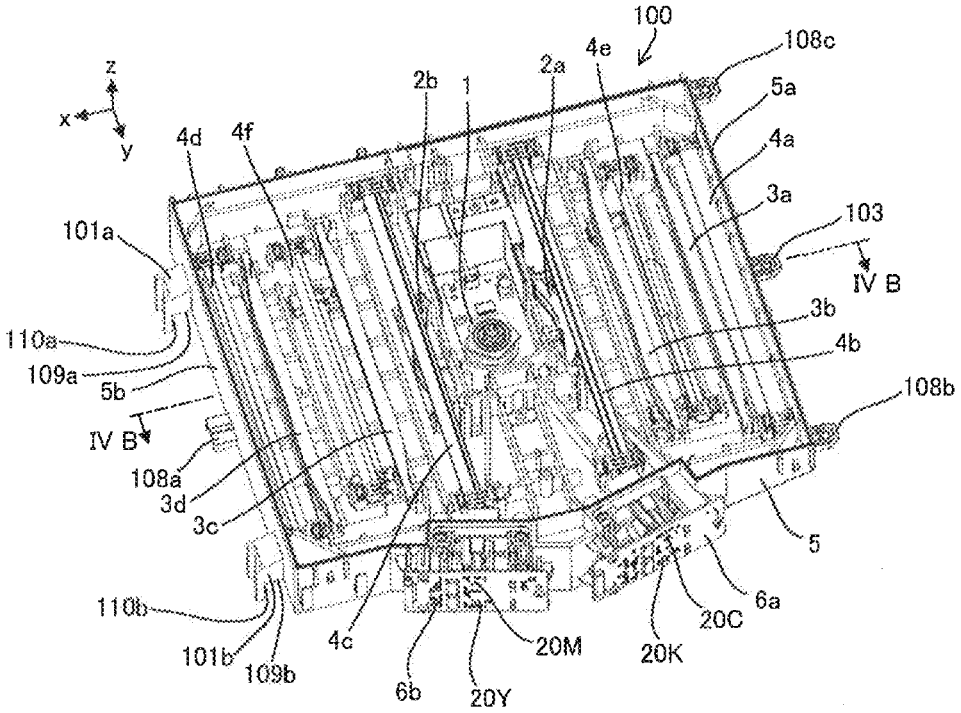
FIGS. 4A, 4B, and 4C are views illustrating the light scanning apparatus according to the first embodiment.
Figure 4B:
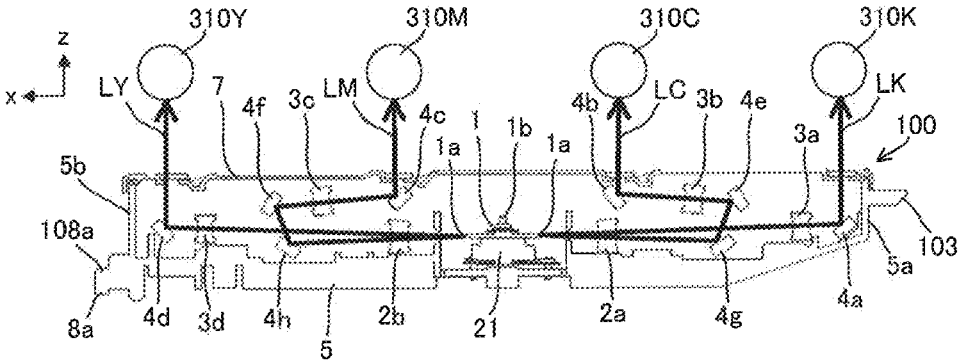
Figure 4C:
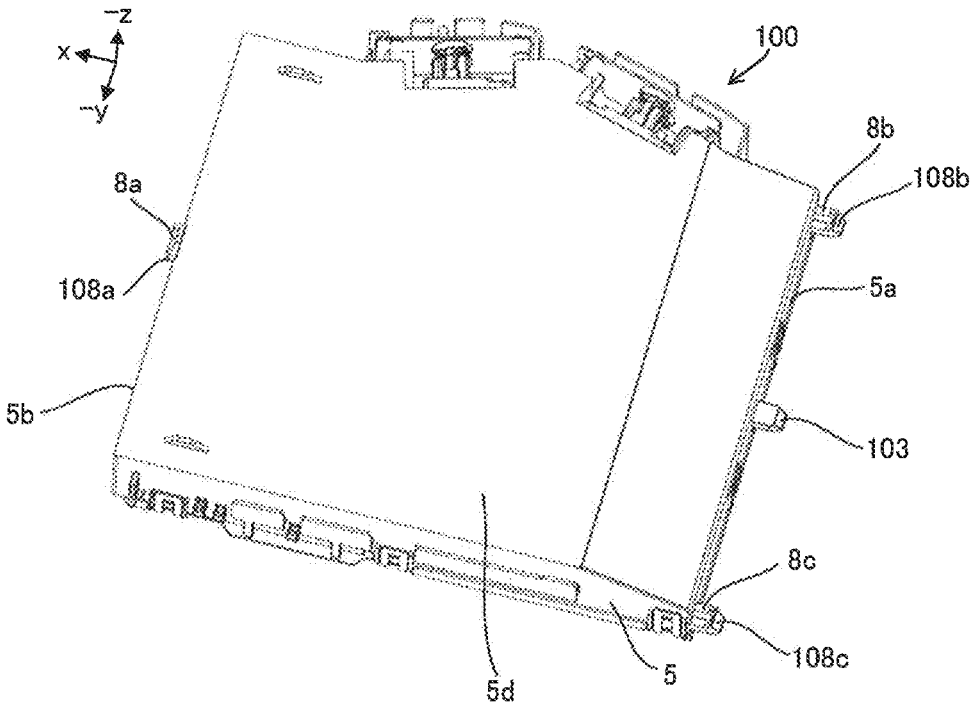

FIGS. 4A, 4B, and 4C are views illustrating the light scanning apparatus 100 according to a first embodiment. FIG. 4A is a perspective view illustrating an internal structure of the light scanning apparatus 100 in a state in which a cover 7 is removed. FIG. 4B is a sub-scanning sectional view of the light scanning apparatus 100, which is taken along the line IVB-IVB of FIG. 4A. The cover 7, which is omitted in FIG. 4A, is mounted on the light scanning apparatus 100 illustrated in FIG. 4B. FIG. 4C is a view illustrating a bottom portion 5*d* of an optical box 5 of the light scanning apparatus 100.

The light scanning apparatus 100 includes the optical box 5 as a housing and the cover 7. In the embodiment, the optical box 5 is formed by injection molding of a polycarbonate-based glass-reinforced resin material. The optical box 5 has a rectangular shape when viewed from above (in a first direction described later). The light scanning apparatus 100 has a rectangular parallelepiped shape.

The light scanning apparatus 100 includes a single rotary polygon mirror (hereinafter referred to as a deflector) 1. The deflector 1 is rotated by a motor 21. The optical box 5 contains the deflector 1.

The light scanning apparatus 100 includes two laser units 6*a* and 6*b*. The laser unit 6*a* includes two light sources 20K and 20C for black and cyan. The laser unit 6*b* includes two light sources 20M and 20Y for magenta and yellow.

The light source 20 (20Y, 20M, 20C, 20K) has a diagonal incidence angle in a vertical direction. The light sources 20K and 20C are arranged so that the light beams LK and LC, which are emitted from the respective light sources 20K and 20C, intersect each other on a deflection surface (reflection surface) 1*a* of the deflector 1. Similarly, the light sources 20M and 20Y are arranged so that the light beams LM and LY, which are emitted from the respective light sources 20M and 20Y, intersect each other on another deflection surface 1*a* of the deflector 1. The deflector 1 is configured to deflect the four light beams LY, LM, LC, and LK by being rotated by the motor 21 so as to scan the photosensitive drums 310 with the respective light beams L.

The laser units 6*a* and 6*b* each include a collimator lens (not shown) configured to convert the light beam L into a collimated light beam. The optical box 5 holds the deflector 1 and the laser units 6*a* and 6*b*. A compound cylindrical lens (not shown) is provided between the deflector 1 and the collimator lens (not shown). The compound cylindrical lens (not shown) is configured to condense the two light beams L, which are emitted from the two respective light sources 20, into a linear shape, which extends in a main scanning direction, on the deflection surface of the deflector 1.

In this case, the main scanning direction is a direction perpendicular to a rotation shaft 1*b* of the deflector 1. Regarding the main scanning direction, the direction of an optical axis differs between an incidence optical system form the light source 20 to the deflector 1 and an imaging optical system from the deflector 1 to the photosensitive drum 310. A sub-scanning direction is a direction perpendicular to the optical axis of the incidence optical system or the imaging optical system, and in addition, a direction perpendicular to the main scanning direction (direction parallel to the rotation shaft 1*b* of the deflector 1). A main scanning cross section is a cross section cut along a plane including the optical axis of the imaging optical system and being parallel to the main scanning direction. A sub-scanning cross section is a cross section cut along a plane including the optical axis of the incidence optical system or the imaging optical system and being perpendicular to the main scanning cross section. In the embodiment, as illustrated in FIG. 4A, the optical axis direction of the imaging optical system is represented as an x direction, the main scanning direction is represented as a y direction, and the sub-scanning direction is represented as a z direction.

In FIG. 4A, the light beams LK and LC, which are emitted from the light sources 20K and 20C for black and cyan, are deflected on the deflection surface 1*a* provided on a right side of the deflector 1. The light beams LM and LY, which are emitted from the light sources 20M and 20Y for magenta and yellow, are deflected on the deflection surface 1*a* provided on a left side of the deflector 1. An imaging optical system for the light beams LK and LC are independent from an imaging optical system for the light beams LM and LY.

The imaging optical system for the light beams LK and LC for black and cyan is provided on the right side of the deflector 1 as illustrated in FIGS. 4A and 4B. As illustrated in FIG. 4B, the imaging optical system for the light beams LK and LC includes a first lens 2*a*, second lenses 3*a* and 3*b*, and mirrors 4*a*, 4*b*, 4*e*, and 4*g*. The first lens 2*a*, the second lenses 3*a* and 3*b*, and the mirrors 4*a*, 4*b*, 4*e*, and 4*g* are fixed to the optical box 5.

The imaging optical system for the light beams LM and LY for magenta and yellow is provided on the left side of the deflector 1 as illustrated in FIGS. 4A and 4B. As illustrated in FIG. 4B, the imaging optical system for the light beams LM and LY includes a first lens 2*b*, second lenses 3*c* and 3*d*, and mirrors 4*c*, 4*d*, 4*f*, and 4*h*. The first lens 2*b*, the second lenses 3*c* and 3*d*, and the mirrors 4*c*, 4*d*, 4*f*, and 4*h* are fixed to the optical box 5.

The light beams LY, LM, LC, and LK are condensed by the imaging optical systems onto the surfaces of the photosensitive drums 310Y, 310M, 310C, and 310K, respectively.

FIG. 4B illustrates optical paths of the light beams LY, LM, LC, and LK, which pass inside the light scanning apparatus 100. The light beam L emitted from the laser unit 6 (6*a*, 6*b*) is deflected by the deflector 1. The light beam LK for black passes through the first lens 2*a* and the second lens 3*a*, and is reflected upward by the mirror 4*a* so as to be guided onto the photosensitive drum 310K for black. After passing through the first lens 2*a*, the light beam LC for cyan is reflected by the mirrors 4*g* and 4*e*, and passes through the second lens 3*b* so as to be guided by the mirror 4*b* onto the photosensitive drum 310C for cyan. The light beam LY for yellow passes through the first lens 2*b* and the second lens 3*d*, and is guided by the mirror 4*d* onto the photosensitive drum 310Y for yellow. After passing through the first lens 2*b*, the light beam LM for magenta is reflected by the mirrors 4*h* and 4*f*, and passes through the second lens 3*c* so as to be guided by the mirror 4*c* onto the photosensitive drum 310M for magenta.

To uniform shapes of light spots formed on the respective surfaces of the photosensitive drums 310, it is necessary to set uniform optical path lengths each from the light source 20 to the surface of the photosensitive drum 310. Therefore, to set uniform the optical path lengths of the four light beams LY, LM, LC, and LK, the plurality of mirrors 4*b*, 4*e*, and 4*g* and 4*c*, 4*f*, and 4*h* are arranged in the optical path of the light beam LC for cyan and the optical path of the light beam LM for magenta, respectively.

The optical box 5 is inserted into a main body of the image forming apparatus horizontally in a −x direction through an insertion port (insertion portion), which is formed in a side wall on a left side of the image forming apparatus illustrated in FIG. 9. Note that, the insertion port may be formed in another side wall of the image forming apparatus so that the optical box 5 is mounted to the main body of the image forming apparatus while moving horizontally in a +x direction of the image forming apparatus illustrated in FIG. 9. Further, the insertion port may be formed in the side wall so that the optical box 5 shown in FIGS. 1A and 1B may be mounted to the main body of the image forming apparatus while moving horizontally in the y direction of the image forming apparatus. Still further, an inserting direction (moving direction) at the time when the optical box 5 is mounted to the main body of the image forming apparatus may not be completely the horizontal direction as long as the optical box 5 is inserted at an acute angle with respect to the horizontal direction. In a case of a color image forming apparatus illustrated in FIG. 9, for example, the optical box 5 may be mounted to the main body of the image forming apparatus while the optical box 5 is inserted into the main body of the image forming apparatus in the horizontal direction along or an oblique direction with respect to an arranging direction of the plurality of image forming portions (image forming portions 300Y, 300M, 300C, and 300K).

A fixing portion 108*a* (near-side fixing portion) and horizontal mounting portions (connecting portions) 101 (101*a* and 101*b*) are provided on a side wall 5*b* of the optical box 5 on the near side (upstream side in the inserting direction or one side) in the inserting direction of the optical box 5 at the time when the optical box 5 is mounted to the main body of the image forming apparatus. The fixing portion (third protrusion) 108*a* protrudes in a direction (the +x direction) opposite to the inserting direction of the optical box 5 from the side wall 5*b*, which is provided on the near side of the optical box 5. Further, the horizontal mounting portions 101 are protrusions which extend (protrude) from the side wall 5*b* on the near side and extend toward a bottom surface (in the −z direction) of the optical box 5.

Figure 1A:
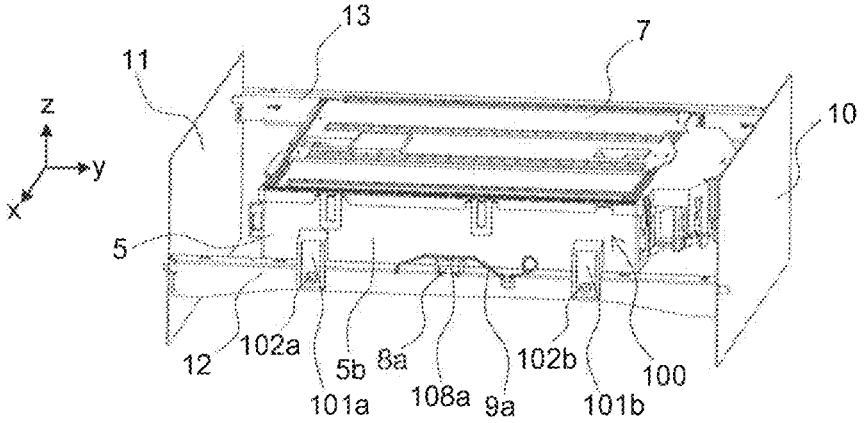
FIGS. 1A and 1B are perspective views of a light scanning apparatus, which is fixed to supporting members, according to a first embodiment.

Note that, the horizontal mounting portion 101 may not protrude from the side wall 5*b* on the near side as illustrated in FIG. 1A, and may protrude from the bottom surface of the optical box 5 in the −z direction. When the horizontal mounting portion 101 protrudes from the bottom surface of the optical box 5 in the −z direction, it is desired that the horizontal mounting portion 101 protrudes from the vicinity of the side wall 5*b* on the near side in the −z direction. That is, it is desired that the horizontal mounting portion 101, which protrudes from the bottom surface of the optical box 5 in the −z direction, be provided within the range of 20 mm or less from the side wall 5*b* on the near side, in order to secure a function of suppressing vibration of the optical box 5, which will be described later.

Fixing portions 108*b* (first far-side fixing portion) and 108*c* (second far-side fixing portion) and a fitting protrusion 103 are provided on a side wall 5*a* of the optical box 5 on a far side (downstream side in the inserting direction or another side opposite to the one side) in the inserting direction of the optical box 5 at the time when the optical box 5 is mounted to the main body of the image forming apparatus. The fixing portion (first protrusion) 108*b*, the fixing portion (second protrusion) 108*c* and the fitting protrusion (positioning protrusion) 103 protrude from the side wall 5*a* of the optical box 5, which is provided on the far side in the inserting direction of the optical box 5, in the inserting direction (direction opposite to the x direction, which is hereinafter referred to as −x direction).

As illustrated in FIG. 4C, the bottom portion 5*d* of the optical box 5 of the light scanning apparatus 100 has three seating surfaces 8*a* (third supported portion or third abutment portion), 8*b* (first supported portion or first abutment portion), and 8*c* (second supported portion or second abutment portion). As described later, the seating surface 8*a* is provided on the fixing portion 108*a*. The seating surfaces 8*b* and 8*c* are provided on the fixing portions 108*b* and 108*c*, respectively. The seating surfaces 8*a*, 8*b*, and 8*c* protrude in a direction opposite to the z direction (hereinafter referred to as −z direction).

The three seating surfaces 8*a*, 8*b*, and 8*c* are arranged on respective apexes of an isosceles triangle. However, the arrangement of the seating surfaces 8*a*, 8*b*, and 8*c* is not limited to the isosceles triangle. The arrangement of the seating surfaces 8*a*, 8*b*, and 8*c* may be changed as long as the light scanning apparatus 100 is not substantially deformed. Further, the seating surfaces 8*a*, 8*b*, and 8*c* are arranged in a relative manner so that the optical box 5, which is supported by those seating surfaces at three points, is stabilized.

[Supporting Member]

Figure 1B:
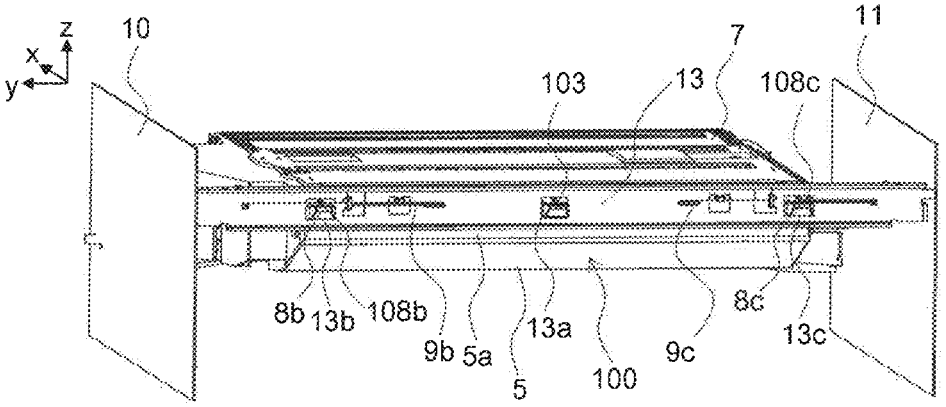

FIGS. 1A and 1B are perspective views of the light scanning apparatus 100, which is fixed to supporting members 12 and 13, according to the first embodiment. FIG. 1A is a rear perspective view of the light scanning apparatus 100. FIG. 1B is a front perspective view of the light scanning apparatus 100.

Two side plates 10 and 11 are provided inside the main body of the image forming apparatus 600. The supporting members (supporting units) 12 and 13 are fixed to the two side plates 10 and 11 or a frame with screws (not shown) so as to bridge between (be suspended from) the two side plates 10 and 11. That is, the supporting members 12 and 13 serve as beam members (supporting beams) configured to connect the two side plates 10 and 11. In the embodiment, the two supporting members 12 and 13 are used, but the embodiment is not limited thereto. For example, one supporting member may be used, or three or more supporting members may be used.

Although not illustrated herein, the photosensitive drum 310, the charging roller 330, the developing device 320, the primary transfer roller 340, and the cleaning device 350 of the image forming apparatus 600 are supported by other respective supporting members (not shown) which bridge between the side plates 10 and 11.

FIGS. 2A, 2B, 2C, and 2D are views illustrating the fixing portion 108*a*, the horizontal mounting portion 101 (101*a*, 101*b*), the fixing portion 108*b* (108*c*), and the fitting protrusion 103, respectively.

Figure 2A:
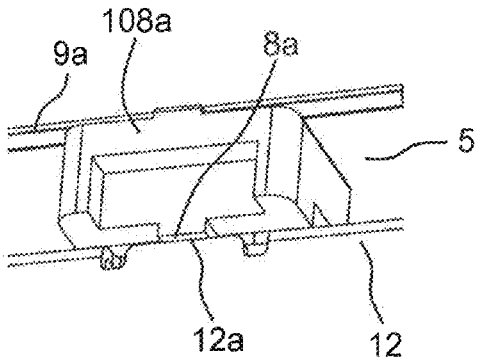
FIGS. 2A, 2B, 2C, and 2D are views illustrating a fixing portion, a horizontal mounting portion, a fixing portion, and a fitting protrusion, respectively.

The light scanning apparatus 100 includes the fixing portion 108*a*, the horizontal mounting portions 101 (101*a* and 101*b*), the fixing portions 108*b* and 108*c*, and the fitting protrusion 103. As described above, the seating surfaces 8*a*, 8*b*, and 8*c* are provided on the bottom portion 5*d* of the optical box 5. Specifically, the seating surface 8*a* is provided on a lower part of the fixing portion 108*a* as illustrated in FIG. 2A. The seating surfaces 8*b* and 8*c* are provided on lower parts of the fixing portions 108*b* and 108*c*, respectively, as illustrated in FIG. 2C.

Figure 2B:
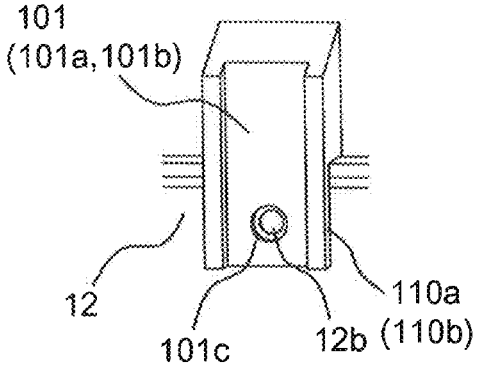

As illustrated in FIG. 2B, a mounting hole 101*c* is formed in the horizontal mounting portion 101. Further, a receiving portion (reference surface) 12*a* (FIG. 2A), two screw holes 12*b*, and a wire spring 9*a* are provided on the supporting member (first supporting member) 12. The receiving portion 12*a* supports the fixing portion 108*a*.

Figure 2C:
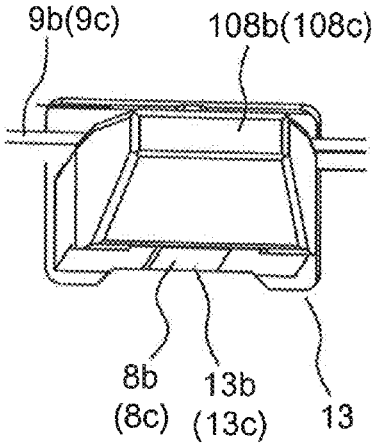
Figure 2D:
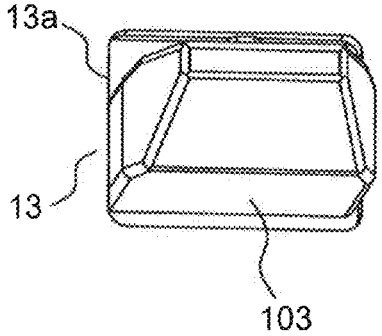

As illustrated in FIGS. 1B, 2C, and 2D, a fitting hole 13*a*, two receiving portions (reference surfaces) 13*b* and 13*c*, and wire springs 9*b* and 9*c* are provided on the supporting member (second supporting member) 13. The supporting member 13 includes a first insertion portion and a second insertion portion. The first insertion portion is provided with the receiving portion 13*b*. The fixing portion 108*b* is inserted into the first insertion portion as the optical box 5 is inserted into the main body of the image forming apparatus. The second insertion portion is provided with the receiving portion 13*c*. The fixing portion 108*c* is inserted into the second insertion portion as the optical box 5 is inserted into the main body of the image forming apparatus. The fixing portion 108*b* is inserted into the first insertion portion so that the receiving portion 13*b* supports the fixing portion 108*b*. The fixing portion 108*c* is inserted into the second insertion portion so that the receiving portion 13*c* supports the fixing portion 108*c*.

The light scanning apparatus 100 is positioned by the receiving portion (third supporting portion) 12*a* and the two screw holes 12*b* of the supporting member 12 and the fitting hole 13*a*, the receiving portion (first supporting portion) 13*b*, and the receiving portion (second supporting portion) 13*c* of the supporting member 13. The light scanning apparatus 100 is fixed to the supporting members 12 and 13.

(Positioning Method)

Now, a method of positioning the light scanning apparatus 100 with respect to the image forming apparatus 600 in each of the x, y, and z directions will be described.

As illustrated in FIG. 2A, the seating surface 8*a* of the light scanning apparatus 100 is held in abutment against the receiving portion 12*a* of the supporting member 12 in the −z direction (first direction). As illustrated in FIG. 2C, the seating surfaces 8*b* and 8*c* of the light scanning apparatus 100 are held in abutment against the receiving portions 13*b* and 13*c* of the supporting member 13 in the −z direction (first direction), respectively. When the seating surfaces 8*a*,

8*b*, and 8*c* are held in abutment against the receiving portions 12*a*, 13*b*, and 13*c*, respectively, the light scanning apparatus 100 is positioned with respect to the image forming apparatus 600 in the z direction. In the embodiment, the z direction (a supporting direction) corresponds to a vertically upward direction. That is, the fixing portions 108*b* and 108*c* are supported by the receiving portions 13*b* and 13, respectively, so that the optical box 5 is positioned by the supporting member 13 in the z direction (the supporting direction).

As illustrated in FIG. 2D, the fitting protrusion 103 of the light scanning apparatus 100 is fitted into the fitting hole (fitting portion) 13*a* of the supporting member 13. When the fitting protrusion 103 is fitted into the fitting hole 13*a*, the light scanning apparatus 100 is positioned with respect to the image forming apparatus 600 in the y direction (third direction) orthogonal to the z direction (the supporting direction).

As illustrated in FIG. 4A, the horizontal mounting portion 101 (101*a*, 101*b*) of the light scanning apparatus 100 has a flat surface 109 (109*a*, 109*b*) and a receiving portion (second opposing surface) 110 (110*a*, 110*b*). The horizontal mounting portion 101 (101*a*, 101*b*) are formed integrally with the optical box 5. The receiving portions 110 are held in abutment against the supporting member 12 in a state in which the fixing portions 108*b* and 108*c* on the side wall 5*a* on the far side of the optical box 5 are fitted into the fitting holes 13*b* and 13*c* of the supporting member 13, respectively.

The supporting member 12 is provided immediately below the flat surface 109 (109*a*, 109*b*). The flat surfaces 109 are not held in abutment against the supporting member 12. As illustrated in FIGS. 1A and 2B, the receiving portion 110 (110*a*, 110*b*) of the horizontal mounting portion 101 (101*a*, 101*b*) of the light scanning apparatus 100 is held in abutment against the supporting member 12 in the −x direction (second direction). When the receiving portions 110 of the horizontal mounting portions 101 are held in abutment against the supporting member 12, the light scanning apparatus 100 is positioned with respect to the image forming apparatus 600 in the x direction. In the embodiment, the −x direction (second direction) is perpendicular to the −z direction (first direction). However, the embodiment is not limited thereto. The second direction in which the receiving portion 110 (110*a*, 110*b*) is held in abutment against the supporting member 12 only needs to intersect the first direction in which the seating surfaces 8*a*, 8*b*, and 8*c* are held in abutment against the supporting members 12 and 13. The plurality of the horizontal mounting portions 101*a* and 101*b* are provided up right from the side wall on the upstream side in the inserting direction of the optical box 5 so as to be opposed to the supporting member 12 in a state in which the optical box 5 is supported by the supporting member 12. The plurality of the horizontal mounting portions 101*a* and 101*b* opposed to the supporting member 12 are fixed to the supporting member 12 by the screws 102*a* and 102*b* so that vibration generated with the receiving portion 12*a* of the optical box 5 acting as a fulcrum is suppressed.

(Fixing Method)

Now, a method of fixing the light scanning apparatus 100 to the image forming apparatus 600 will be described. As described above, the light scanning apparatus 100 is fixed to the supporting members 12 and 13 of the image forming apparatus 600 as in the following manner in a state in which the light scanning apparatus 100 is positioned with respect to the image forming apparatus 600.

As illustrated in FIG. 2A, in a state in which the seating surface 8*a* of the light scanning apparatus 100 is held in abutment against the receiving portion 12*a* of the supporting member 12 in the −z direction, the fixing portion 108*a* is biased in the vertically downward direction (−z direction) by the wire spring (elastic member) 9*a* mounted on the supporting member 12. With the wire spring 9*a*, the seating surface 8*a* is fixed to the receiving portion 12*a* in the z direction. In this case, the wire spring 9*a* and the receiving portion 12*a* construct a first fixing section configured to fix the seating surface 8*a* to the supporting member 12. It is preferred that the wire spring be a wire made of metal, for example.

As illustrated in FIG. 2C, in a state in which the seating surface 8*b* of the light scanning apparatus 100 is held in abutment against the receiving portion 13*b* of the supporting member 13 in the −z direction, the fixing portion 108*b* is biased in the vertically downward direction (−z direction) by the wire spring (elastic member) 9*b* mounted on the supporting member 13. With the wire spring 9*b*, the seating surface 8*b* is fixed to the receiving portion 13*b* in the z direction. In this case, the wire spring 9*b* and the receiving portion 13*b* construct a first fixing section configured to fix the seating surface 8*b* to the supporting member 13.

Similarly, in a state in which the seating surface 8*c* of the light scanning apparatus 100 is held in abutment against the receiving portion 13*c* of the supporting member 13 in the −z direction, the fixing portion 108*c* is biased in the vertically downward direction (−z direction) by the wire spring (elastic member) 9*c* mounted on the supporting member 13. With the wire spring 9*c*, the seating surface 8*c* is fixed to the receiving portion 13*c* in the z direction. In this case, the wire spring 9*c* and the receiving portion 13*c* construct a first fixing section configured to fix the seating surface 8*c* to the supporting member 13.

In this manner, in a state in which the light scanning apparatus 100 is positioned with respect to the image forming apparatus 600, the light scanning apparatus 100 is fixed to the supporting members 12 and 13 by the respective first fixing sections while avoiding the deformation of the light scanning apparatus 100 due to the flatness of the supporting members 12 and 13 by the three seating surfaces 8.

The horizontal mounting portions 101*a* and 101*b* are fixed to the supporting member 12 by screws (fastening members) 102*a* and 102*b*, respectively, in a state in which the receiving portions 110*a* and 110*b* of the horizontal mounting portions 101*a* and 101*b* are held in abutment against the supporting member 12 in the −x direction. The screws 102*a* and 102*b* are screwed into the screw holes 12*b* of the supporting member 12 through the mounting holes 101*c* of the horizontal mounting portions 101*a* and 101*b*, respectively. The horizontal mounting portions 101*a* and 101*b* of the light scanning apparatus 100 are fixed to the supporting member 12 in the x direction by the screws 102*a* and 102*b*, respectively.

The mounting hole 101*c* is sufficiently larger than the screw hole 12*b*, and hence the screws 102*a* and 102*b* do not affect the positioning of the light scanning apparatus 100 in each direction other than the x direction.

As described above, the horizontal mounting portions 101*a* and 101*b* are fixed to the supporting member 12 by the screws 102*a* and 102*b*, respectively. Thus, torsional vibration in a rotation direction about the seating surface 8*a* can be reduced. Thus, torsional vibration generated in a case of the fixation at only the three seating surfaces 8*a* to 8*c* can be reduced. The specific effect will be described later.

The screw 102 and the screw hole 12*b* construct a second fixing section configured to fix the receiving portion 110 of the horizontal mounting portion 101 to the supporting member 12. Note that, the horizontal mounting portion 101 may be fixed to the supporting member 12 with an adhesive instead of the screw 102. Alternatively, the horizontal mounting portion 101 may be fixed to the supporting member 12 by a biasing force applied by the elastic member.

(Mounting Procedure)

Next, a mounting procedure of fixing the light scanning apparatus 100 to the supporting members 12 and 13 will be described with reference to FIGS. 3A, 3B, and 3C.

Figure 3A:
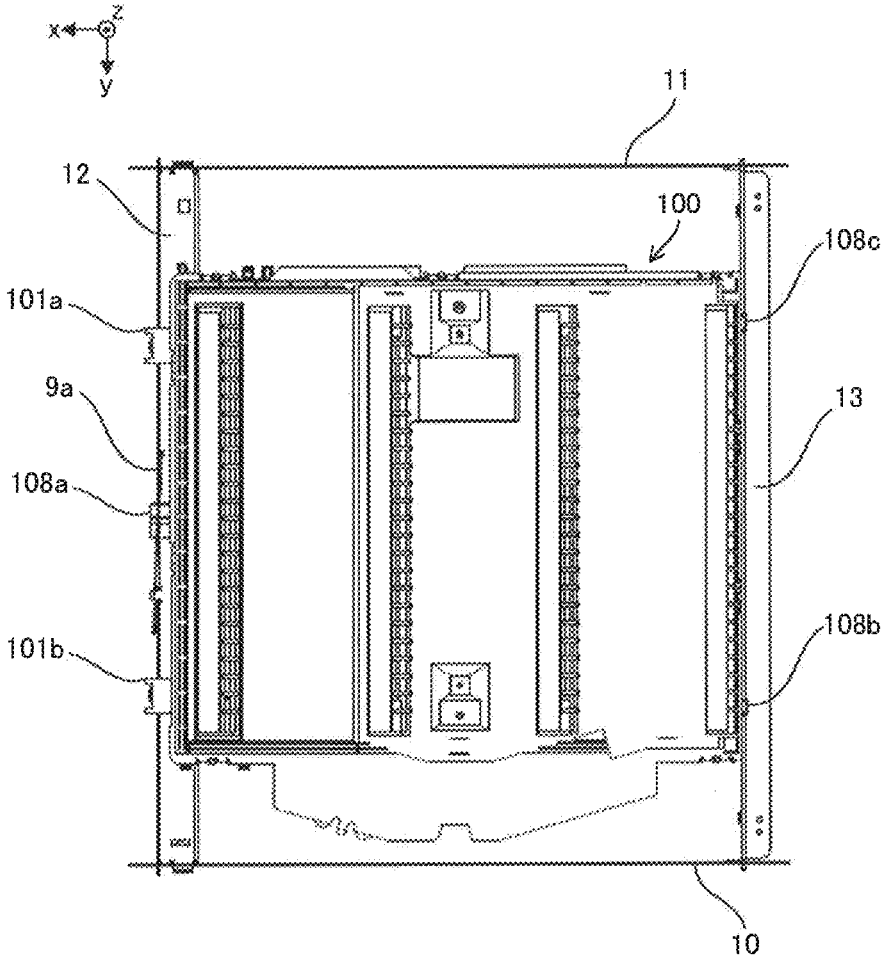
FIGS. 3A, 3B, and 3C are views illustrating the light scanning apparatus, which is fixed to the supporting members, according to the first embodiment.
Figure 3B:
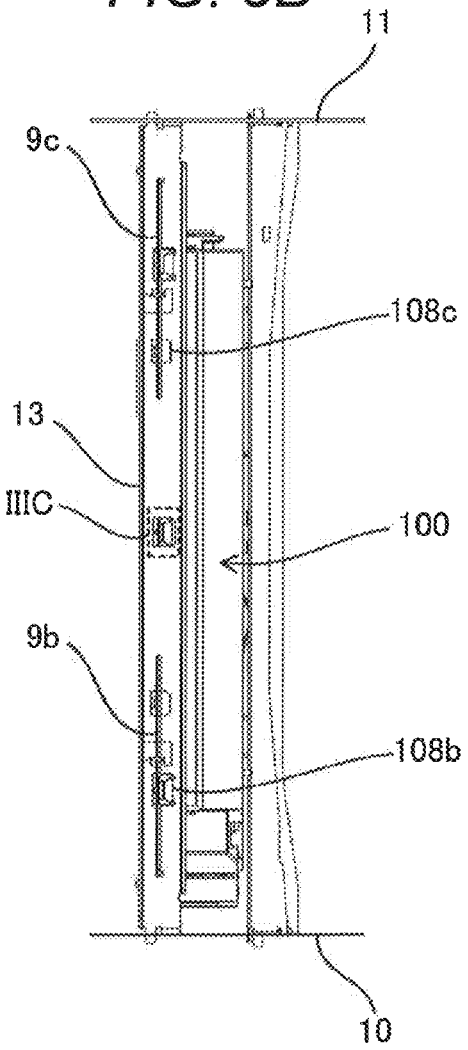
Figure 3C:
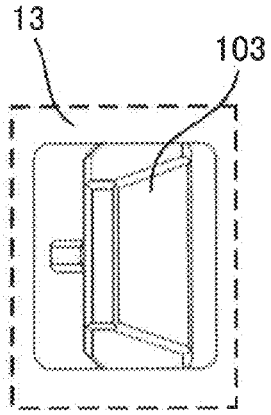

FIGS. 3A, 3B, and 3C are views illustrating the light scanning apparatus 100, which is fixed to the supporting members, according to the embodiment. FIG. 3A is a plan view of the light scanning apparatus 100. FIG. 3B is a front view of the light scanning apparatus 100. FIG. 3C is an enlarged view of a portion IIIC surrounded by the dotted line of FIG. 3B.

First, the light scanning apparatus 100 is inserted into the image forming apparatus 600 in the −x direction (inserting direction), and the fitting protrusion 103 provided on the light scanning apparatus 100 is fitted into the fitting hole 13*a* of the supporting member 13. With this, the light scanning apparatus 100 is positioned in the y direction.

Next, the seating surfaces 8*a*, 8*b*, and 8*c* are brought into abutment against the respective receiving portions 12*a*, 13*b*, and 13*c* of the supporting members 12 and 13. With this, the light scanning apparatus is positioned in the z direction.

Thereafter, the seating surfaces 8*a*, 8*b*, and 8*c* are fixed to the receiving portions 12*a*, 13*b*, and 13*c* by the wire springs 9*a*, 9*b*, and 9*c*, respectively. The wire springs 9*a*, 9*b*, and 9*c* are used herein, and hence, although the frictional resistance is applied, the light scanning apparatus 100 is movable in the −x direction or the x direction at this time.

Next, the receiving portions 110 of the horizontal mounting portions 101 are brought into abutment against the supporting member 12 in the −x direction. With this, the light scanning apparatus is positioned in the x direction and in the rotation direction about the z axis.

Thereafter, the horizontal mounting portions 101*a* and 101*b* are fixed to the supporting member 12 by the screws 102*a* and 102*b*, respectively.

In this manner, the light scanning apparatus 100 is positioned with respect to the image forming apparatus 600 in the x direction, the y direction, and the z direction so as to be fixed to the supporting members 12 and 13.

Note that, the mounting hole 101*c* of each of the horizontal mounting portions 101*a* and 101*b*, through which the screw 102 is extended, is sufficiently larger than screw hole 12*b* of the supporting member 12. Therefore, the fixation of the horizontal mounting portions 101*a* and 101*b* by the screws 102 does not interfere with the positioning with the seating surfaces 8*a*, 8*b*, and 8*c* in the z direction.

Note that, stress concentration may occur due to a rotational moment at the time of fixation by the screws 102 so that surrounding parts of the horizontal mounting portions 101*a* and 101*b* are deformed. As a measure therefor, a double SEMS screw may be used as the screw 102.

Note that, in the embodiment, for the positioning in the x direction and in the rotation direction about the z axis, the horizontal mounting portions 101*a* and 101*b* are provided at two respective positions. However, when positioning means for the x direction and/or the rotation direction about the z axis are additionally provided, the horizontal mounting portion 101 may be provided at one position. This is because, even when only one horizontal mounting portion is provided, a restraining force with respect to a direction of the torsional vibration can be generated, and hence a similar effect can be expected. Further, the above-mentioned positioning method and fixing method are merely an example, and the embodiment is not limited to the above-mentioned methods as long as the light scanning apparatus 100 is appropriately positioned and fixed in all the directions.

[Vibration Reduction for Light Scanning Apparatus]

Verification of anti-vibration property according to the embodiment is performed through analyses. FIGS. 5A, 5B, 5C, and 5D are views illustrating respective vibration modes of the light scanning apparatus 100 which is mounted on the supporting members 12 and 13. The side plates 10 and 11 are omitted in FIGS. 5A, 5B, 5C, and 5D.

Figure 5A:
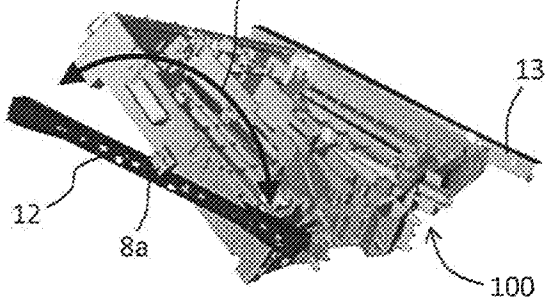
FIGS. 5A, 5B, 5C, and 5D are views illustrating respective vibration modes of the light scanning apparatus which is mounted on the supporting members.
Figure 5B:
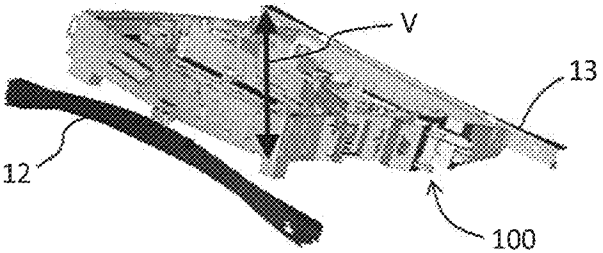
Figure 5C:
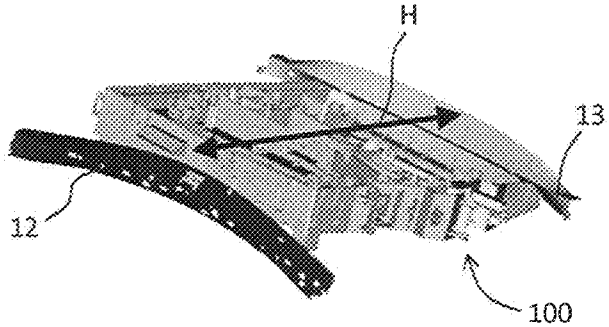
Figure 5D:
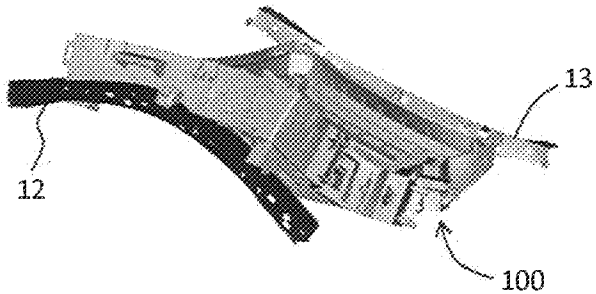

FIG. 5A illustrates torsional vibration in which the light scanning apparatus 100 is twisted in a rotation direction R about the seating surface 8*a*. FIG. 5B illustrates vertical vibration in which the light scanning apparatus 100 is moved parallel to a vertical direction V of FIG. 5B. FIG. 5C illustrates horizontal vibration in which the light scanning apparatus 100 is moved parallel to a horizontal direction H of FIG. 5C. FIG. 5D illustrates bending vibration in which the light scanning apparatus 100 is bent in the vertical direction. The effect of the anti-vibration property in those vibration modes according to the embodiment will be described below.

Figure 6A:
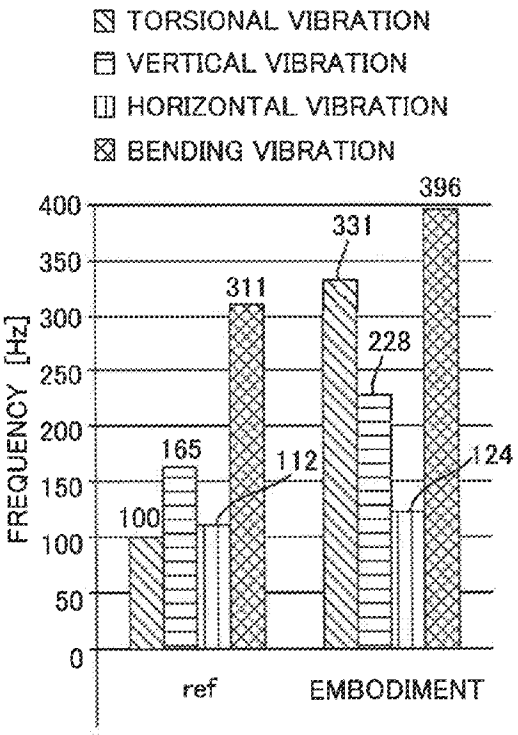
FIGS. 6A, 6B, and 6C are graphs showing respective results of vibration analyses of the light scanning apparatus.
Figure 6B:
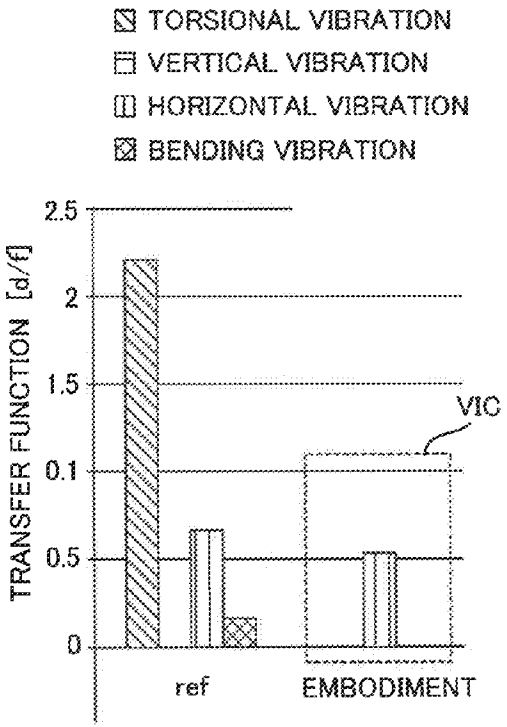
Figure 6C:
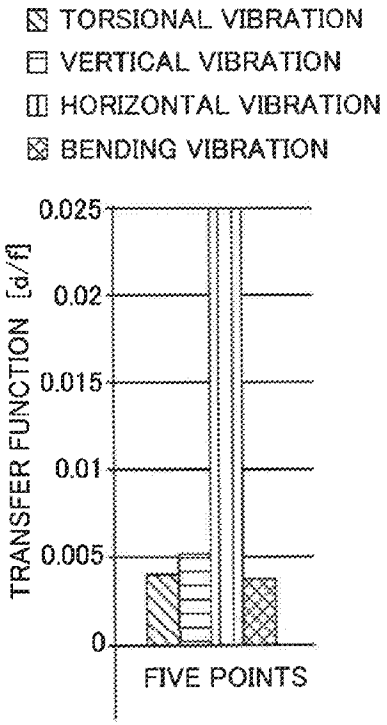

FIGS. 6A, 6B, and 6C are graphs showing respective results of vibration analyses of the light scanning apparatus 100.

FIG. 6A is a graph showing natural frequencies of a light scanning apparatus, which is fixed at three points and is devoid of the horizontal mounting portions, in respective vibration modes according to the conventional art (ref) and natural frequencies of the light scanning apparatus in the respective vibration modes according to the embodiment.

The light scanning apparatus according to the conventional art (ref) and the embodiment are each fixed to the image forming apparatus 600 for a sheet size of A4 to A3 at the three seating surfaces. Due to the weight of the light scanning apparatus and the stiffness of the rectangular parallelepiped shape that is formed of the polycarbonate-based glass-reinforced resin material, in the light scanning apparatus according to the conventional art (ref), torsional vibration is liable to occur at a natural frequency of about 100 Hz. The natural frequency of about 100 Hz corresponds to a driving vibration frequency of a driving source for the photosensitive drum or the developing device of the image forming apparatus 600. Therefore, the light scanning apparatus according to the conventional art (ref) may cause uneven pitch on an image in resonance with the vibration of the driving source. Further, the frequency of about 100 Hz frequently causes easily visually recognizable uneven pitch in a stripe shape of about 1 mm (=process speed/frequency) at a process speed of 70 to 135 mm/s of the image forming apparatus 600. Therefore, it is required that the natural frequency be shifted (changed) from a frequency band of around 100 Hz.

A natural frequency of the torsional vibration of the light scanning apparatus 100 according to the embodiment is shifted to 331 Hz from the natural frequency of 100 Hz of the torsional vibration of the light scanning apparatus according to the conventional art (ref). This is because the horizontal mounting portions 101 are provided, and thus the stiffness of the light scanning apparatus 100 becomes higher with respect to the direction of the torsional vibration.

It is understood from FIG. 6A that the natural frequencies of the light scanning apparatus 100 according to the embodiment become higher also in the other vibration modes.

According to the embodiment, particularly in the torsional vibration, the shift of the natural frequency by about 100 Hz to 200 Hz can be attained, and hence image deterioration due to the uneven pitch can be reduced.

FIG. 6B shows transfer functions of vibrations transmitted to the light scanning apparatus 100 from a side plate (not shown), on which respective driving sources of the image forming apparatus 600 are mounted, in the respective vibration modes of the natural frequencies shown in FIG. 6A. FIG. 6C is an enlarged view of a part VIC surrounded by the dotted line of FIG. 6B.

As the value of the transfer function is large, the light scanning apparatus 100 is easily vibrated. When the embodiment is compared to the conventional art (ref), the transfer function of the torsional vibration is reduced from 2.2 to about 0.004. That is, the transfer function of the torsional vibration according to the embodiment is reduced by about 550 times as compared to that of the conventional art (ref). The transfer functions of the other vibration modes according to the embodiment are also reduced by about 1.2 to 40 times as compared to those of the conventional art (ref). It is confirmed from this fact that the embodiment has a vibration suppressing effect.

As described above, according to the embodiment, it is possible to increase the natural frequencies and exert the vibration suppressing effect not only in the torsional vibration at the three seating surfaces but also in the other vibration modes, to thereby reduce the uneven pitch in the image forming apparatus 600.

Second Embodiment

Figure 7:
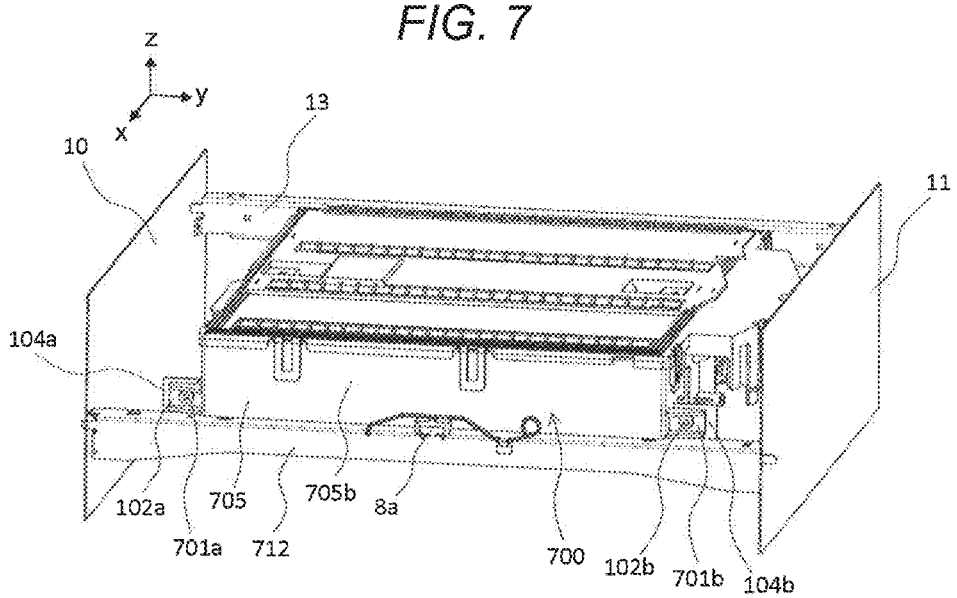
FIG. 7 is a perspective view of a light scanning apparatus, which is fixed to supporting members, according to a second embodiment.

FIG. 7 is a perspective view of a light scanning apparatus 700, which is fixed to supporting members, according to a second embodiment. In the second embodiment, components similar to those of the first embodiment are denoted by same reference symbols, and description thereof is omitted herein. The light scanning apparatus 700 according to the second embodiment has a similar configuration to that of the light scanning apparatus 100 according to the first embodiment except that horizontal mounting portions 701 (701*a* and 701*b*) are provided instead of the horizontal mounting portions 101 of the light scanning apparatus 100 according to the first embodiment.

In the first embodiment illustrated in FIG. 1A, the horizontal mounting portions 101*a* and 101*b* of the light scanning apparatus 100 are formed so as to protrude in a downward direction (−z direction) of the light scanning apparatus 100. On the other hand, as illustrated in FIG. 7, the light scanning apparatus 700 according to the second embodiment includes the horizontal mounting portions 701*a* and 701*b* which protrude in a lateral direction (y direction and a direction opposite to the y direction (hereinafter referred to as −y direction)). Specifically, the horizontal mounting portions 701*a* and 701*b* protrude in the lateral direction (y direction and −y direction) from a rear surface 705*b* of an optical box 705 or parts in the vicinity of the rear surface 705*b*.

Mounting holes (not shown), through which the screws 102 (102*a* and 102*b*) are extended, are formed in the horizontal mounting portions 701*a* and 701*b*, respectively. A supporting member 712 includes the fixing portions 104*a* and 104*b* to which the horizontal mounting portions 701*a* and 701*b* are fixed, respectively. The fixing portions 104*a* and 104*b* protrude from the supporting member 712 in the z direction. The fixing portions 104*a* and 104*b* each have a screw hole (not shown) formed therein with which the screw 102 is threadedly engaged.

The horizontal mounting portions 701*a* and 701*b* include receiving portions (second abutment surfaces) (not shown), which are held in abutment against the fixing portions 104*a* and 104*b* of the supporting member 712 in the −x direction (second direction), respectively.

The horizontal mounting portions 701 of the light scanning apparatus 700 are fixed to the fixing portions 104 by the screws 102 in a state in which the receiving portions of the horizontal mounting portions 701 are held in abutment against the fixing portions 104 of the supporting member 712.

The screws 102 and the fixing portions 104 construct a second fixing section configured to fix the receiving portions of the horizontal mounting portions 701 to the supporting member 712.

According to the second embodiment, a similar effect to that of the first embodiment can be obtained.

Third Embodiment

Figure 8:
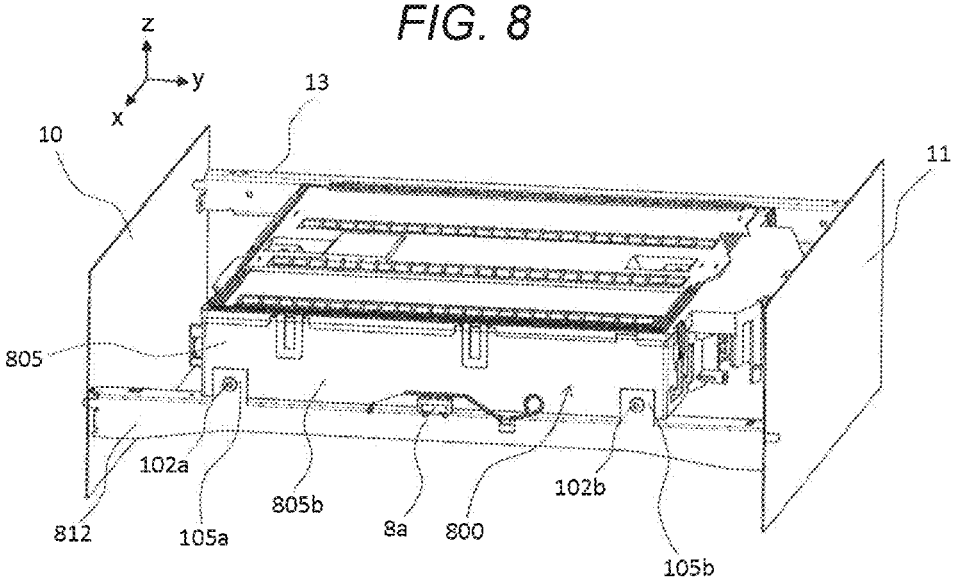
FIG. 8 is a perspective view of a light scanning apparatus, which is fixed to supporting members, according to a third embodiment.

FIG. 8 is a perspective view of a light scanning apparatus 800, which is fixed to supporting members, according to a third embodiment. In the third embodiment, components similar to those of the first embodiment are denoted by same reference symbols, and description thereof is omitted herein. The light scanning apparatus 800 according to the third embodiment has a similar configuration to that of the light scanning apparatus 100 according to the first embodiment except that screw holes (not shown) are formed instead of the horizontal mounting portions 101 of the light scanning apparatus 100 according to the first embodiment.

In the third embodiment, two screw holes (not shown) are formed in a rear surface 805*b* of an optical box 805 of the light scanning apparatus 800.

Fixing portions 105 (105*a* and 105*b*) are provided on a supporting member 812. The fixing portions 105*a* and 105*b* protrude from the supporting member 812 in the z direction. Mounting holes (not shown), through which the screws 102 (102*a* and 102*b*) are extended, are formed in the fixing portions 105*a* and 105*b*, respectively.

Around the screw holes (not shown), the rear surface 805*b* of the optical box 805 includes receiving portions (second abutment surfaces) (not shown), which are held in abutment against the fixing portions 105 of the supporting member 812 in the x direction (direction opposite to the inserting direction), respectively.

The optical box 805 of the light scanning apparatus 800 is fixed to the fixing portions 105 of the supporting member 812 by the screws 102 in a state in which the receiving portions of the optical box 805 are held in abutment against the fixing portions 105 of the supporting member 812.

The screws 102, the fixing portions 105, and the screw holes (not shown) of the optical box 805 construct a second fixing section configured to fix the receiving portions of the optical box 805 to the supporting member 812.

According to the third embodiment, a similar effect to that of the first embodiment can be obtained.

According to the above-mentioned embodiments, the light scanning apparatus is fixed at the both sides of the seating surface 8*a* in the horizontal direction, and hence it is possible to exert the vibration suppressing effect not only in the torsional vibration but also in the other vibration modes. Note that, a horizontal mounting portion having a similar positioning function and fixing function to those of the embodiment may be provided on a lower portion, a side portion, and/or an upper portion of the light scanning apparatus.

According to the embodiment, it is possible to reduce the torsional vibration of the light scanning apparatus while avoiding the deformation of the light scanning apparatus due to the flatness of the supporting unit by the three supporting portions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-006828, filed Jan. 17, 2014, and Japanese Patent Application No. 2014-264727, filed Dec. 26, 2014, which are hereby incorporated by reference herein in their entirety.

What is claimed is:

1. An image forming apparatus, comprising:

a photosensitive member;

a light scanning apparatus including:

a deflector configured to deflect a light beam so that the light beam scans a surface of the photosensitive member; and an optical box configured to contain the deflector, the optical box being inserted through an insertion portion formed in a side wall of a main body of the image forming apparatus so that the light scanning apparatus is mounted to the main body of the image forming apparatus;

a supporting unit including a first supporting portion, a second supporting portion, and a third supporting portion, the supporting unit being configured to support the optical box, the first supporting portion and the second supporting portion being configured to support, in a direction intersecting an inserting direction of inserting the optical box into the main body of the image forming apparatus, the optical box in a vicinity of a side wall of the optical box on a downstream side in the inserting direction, the third supporting portion being configured to support the optical box in a vicinity of a side wall of the optical box on an upstream side in the inserting direction, the third supporting portion being positioned between the first supporting portion and the second supporting portion in the direction intersecting the inserting direction;

a first connecting portion configured to connect the optical box supported by the supporting unit and the main body of the image forming apparatus in the vicinity of the side wall of the optical box on the upstream side in the inserting direction and on one side of the third supporting portion in the direction intersecting the inserting direction of the optical box; and a second connecting portion configured to connect the optical box supported by the supporting unit and the main body of the image forming apparatus in the vicinity of the side wall of the optical box on the upstream side in the inserting direction and on at least another side of the third supporting portion in the direction intersecting the inserting direction of the optical box.

2. An image forming apparatus according to claim 1, wherein the first and second connecting portions are provided upright from the side wall of the optical box on the upstream side in the inserting direction so that parts of the supporting unit on the one side and the other side of the third supporting portion are opposed to the first and second connecting portions in a state in which the optical box is supported by the supporting unit, and the first and second connecting portions opposed to the parts of the supporting unit are fixed to the parts of the supporting unit by screws so that vibration generated with the third supporting portion of the optical box acting as a fulcrum is suppressed.

3. An image forming apparatus according to claim 1, wherein the optical box is provided with a first protrusion and a second protrusion which protrude in the inserting direction from the side wall of the optical box, wherein the supporting unit includes:

a first insertion portion into which the first protrusion is inserted when the optical box is inserted into the main body of the image forming apparatus, the first insertion portion being provided with the first supporting portion; and a second insertion portion into which the second protrusion is inserted when the optical box is inserted into the main body of the image forming apparatus, the second insertion portion being provided with the second supporting portion, and wherein the first protrusion is inserted into the first insertion portion so that the first supporting portion supports the first protrusion and the second protrusion is inserted into the second insertion portion so that the second supporting portion supports the second protrusion.

4. An image forming apparatus according to claim 3, wherein the optical box includes a positioning protrusion which protrudes in the inserting direction from the side wall of the optical box on the downstream side in the inserting direction, wherein the supporting unit includes a fitting portion into which the positioning protrusion is inserted when the optical box is inserted into the main body of the image forming apparatus, the positioning protrusion being fitted into the fitting portion in a direction orthogonal to the inserting direction of the optical box and to a supporting direction of the optical box, and wherein the first insertion portion and the second insertion portion are respectively formed on both sides of the fitting portion in the direction orthogonal to the inserting direction and to the supporting direction.

5. An image forming apparatus according to claim 4, wherein the optical box is provided with a third protrusion which protrudes in a direction opposite to the inserting direction from the side wall, wherein the supporting unit includes a first support beam and a second support beam provided on both sides of the optical box in the inserting direction and suspended from a frame of the image forming apparatus, wherein the first support beam is provided downstream of the optical box in the inserting direction and includes the first insertion portion, the second insertion portion, and the fitting portion, and wherein the second support beam is provided upstream of the optical box in the inserting direction and includes the third supporting portion supporting the third protrusion.

6. An image forming apparatus according to claim 3, wherein the optical box is provided with a third protrusion which protrudes in a direction opposite to the inserting direction from the side wall, wherein the supporting unit includes a first support beam and a second support beam provided on both sides the optical box in the inserting direction and suspended form a frame of the image forming apparatus, wherein the first support beam is provided downstream of the optical box in the inserting direction and includes the first insertion portion and the second insertion portion, and wherein the second support beam is provided upstream of the optical box in the inserting direction and includes the third supporting portion supporting the third protrusion.

* * * * *